US005189838A

United States Patent [19]

Westfall

[11] Patent Number: 5,189,838

[45] Date of Patent: Mar. 2, 1993

[54] TILT SASH LOCK SHOE SYSTEM

[75] Inventor: Norman R. Westfall, Rochester, N.Y.

[73] Assignee: Caldwell Manufacturing Company, Rochester, N.Y.

[21] Appl. No.: 896,427

[22] Filed: Jun. 10, 1992

[51] Int. Cl.[5] ..... E05D 15/22; E05D 13/12

[52] U.S. Cl. ..... 49/181; 49/446; 49/453

[58] Field of Search ..... 49/181, 176, 446, 453, 49/454

[56] References Cited

U.S. PATENT DOCUMENTS 3,197,819 8/1965 Trout .
3,233,278 2/1966 Lundgren .
3,524,282 8/1970 Kraft et al. .
3,797,168 3/1974 Trout .
4,271,631 6/1981 Trout .
4,799,333 1/1989 Westfall et al. .
4,885,871 12/1989 Westfall et al. .
4,914,861 4/1990 May ..... 49/181
4,922,657 5/1990 Foss ..... 49/181

*Primary Examiner*—Philip C. Kannan
*Attorney, Agent, or Firm*—Eugene Stephens & Associates

[57] ABSTRACT

A counterbalance shoe of a tilt sash lock shoe system runs in a resin shoe channel of a jamb liner and locks against a rib extending into the shoe channel so that the rib is backed up by a surface of the shoe. A locking element carried by the shoe is counterbalanced into a locked position in which a biting edge of the lock element bites into a front side of the rib. A non-circular sash pin carried by a sash and supported by the shoe at the bottom of an open top slot in the shoe engages and separates confronting surfaces of the shoe and the locking element. The pin is configured for separating the confronting surfaces by enough to hold the locking element out of locked position when the sash is untilted and for reducing the separation of the confronting surfaces to move the locking element into locked position when the sash tilts.

40 Claims, 3 Drawing Sheets

TILT SASH LOCK SHOE SYSTEM

BACKGROUND

Windows with tilt sash supported by counterbalanced shoes have used a variety of shoe locks for holding the shoes in place within jamb liner channels when a sash is tilted, and many of these locking systems have used biters that bite into the plastic surfaces of jamb liners that are formed of extruded resin material. Although there are many previous suggestions for such biting lock shoe systems, including U.S. Pat. Nos. 3,197,819; 3,233,278; 3,524,282; 3,797,168; 4,271,631; 4,799,333; and 4,885,871, all of these have suffered from one or more of the following problems: lack of reliability in holding the shoes in place against counterbalance spring force when a sash is tilted or removed; inability to accommodate all the mishaps associated with window installation, including bowed jambs and dry wall dust or other debris entering the shoe channels; parts failures requiring expensive repairs or replacements after windows are installed; lack of durability causing performance to diminish with use so that a sash no longer operates smoothly and locks correctly upon tilting; inconvenience in use requiring awkward manipulations of a sash or requiring that sash pins be replaced accurately into recesses in shoes locked in jamb liner channels; and expense or complexity resulting in an overly large manufacturing cost and selling price.

The tilt sash lock shoe system of this invention solves all these problems with a simple, inexpensive, and reliable biter shoe that is convenient to operate and readily endures the abuses encountered by windows. A preferred embodiment of this lock shoe system uses a single shoe that can accommodate sash tilt in either direction so that the one shoe can be installed on either side of a window.

SUMMARY OF THE INVENTION

The counterbalance lock shoe of a tilt sash shoe system runs in a shoe channel of a resin jamb liner and locks against a rib that extends into the channel and is backed up by a surface of the shoe. The locking element that bites into the rib is carried by the shoe and biased by the counterbalance spring into its locked position where it bites into the front side of the rib. A non-circular sash pin is carried by the sash and supported by the shoe and arranged to separate confronting surfaces of the shoe and the locking element to hold the locking element out of biting position when the sash is untilted and to allow the locking element to bite when the sash tilts. The sash pin engages the locking element at a moment arm that is substantially shorter than a moment arm for the engagement of the counterbalance element with the locking element, and a small movement of the locking element at the sash pin results in a substantially larger movement of the locking element at its biting edge.

DRAWINGS

Figure 1:
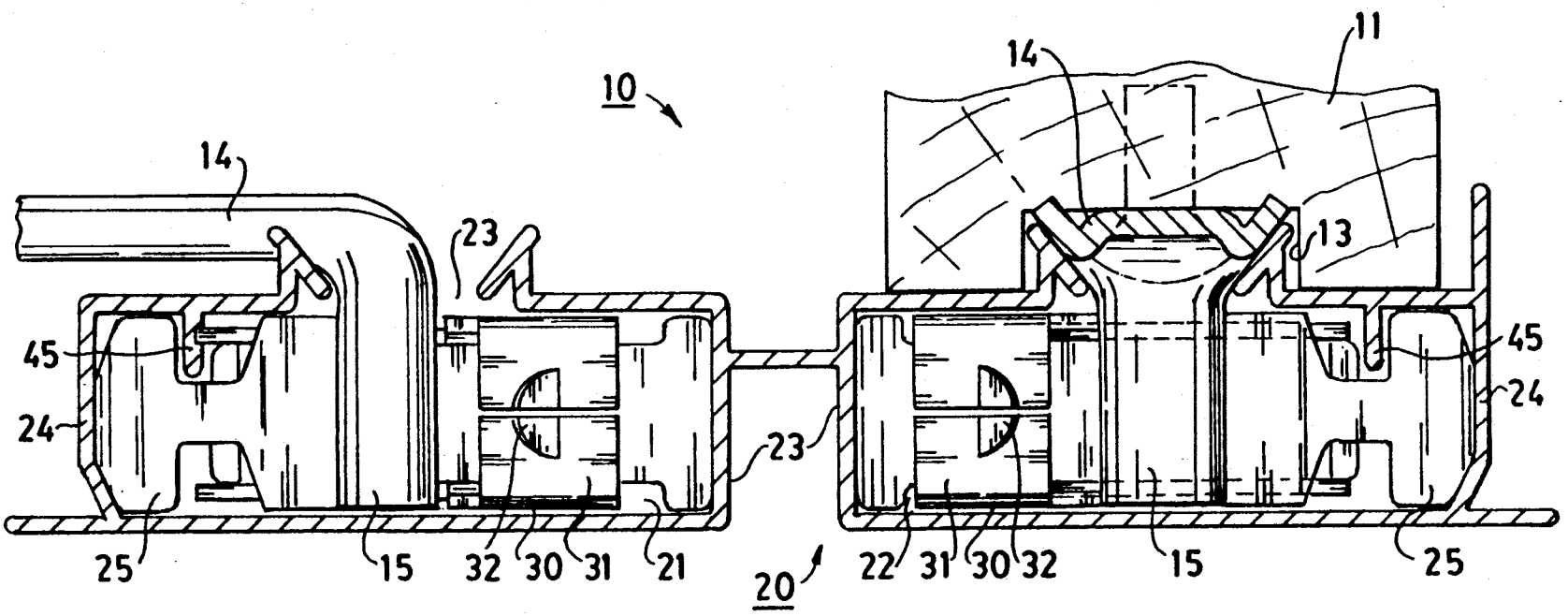
FIG. 1 is a cross-sectional view of a preferred embodiment of the inventive lock system system, showing shoes without counterbalance springs running in resin jamb liner channels for a double-hung window, with a fragment of an untilted sash shown running against the right hand channel, and the sash pin and support bracket for a tilted sash shown for the left hand channel.
Figure 2:
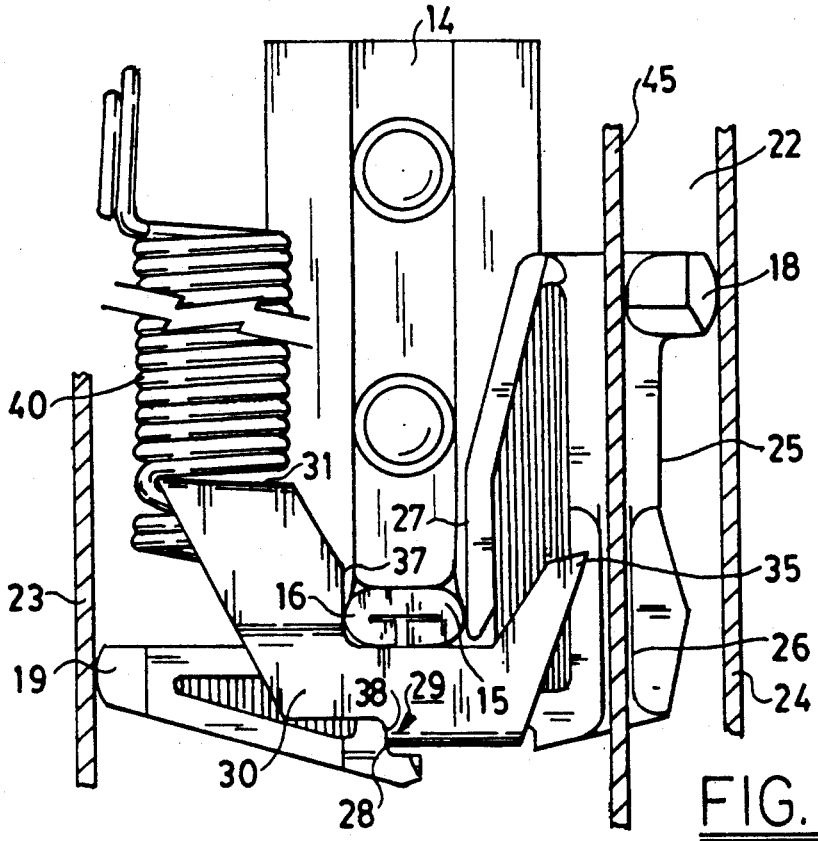
FIG. 2 is a partially fragmentary, elevational view of a lock shoe, sash pin and bracket, and counterbalance spring in an untilted sash position, corresponding to the position shown in the right hand jamb liner channel of FIG. 1.
Figure 3:
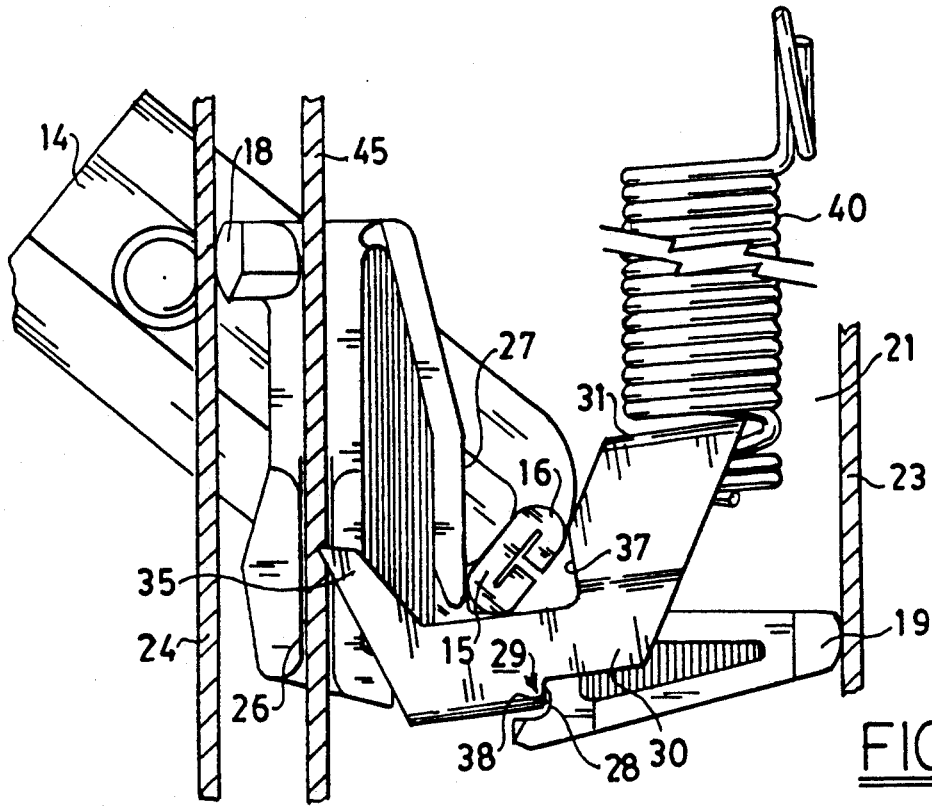
FIG. 3 is a partially fragmentary, elevational view of a lock shoe, sash pin and bracket, and counterbalance spring in a tilted sash position, corresponding to the position shown in the left hand channel of FIG. 1.
Figure 4A:
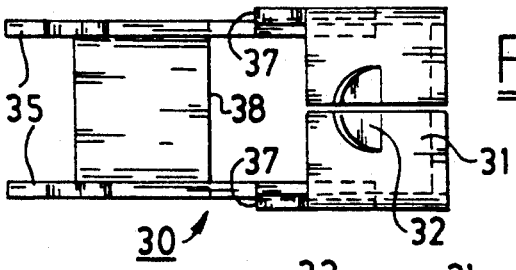
Figure 4B:
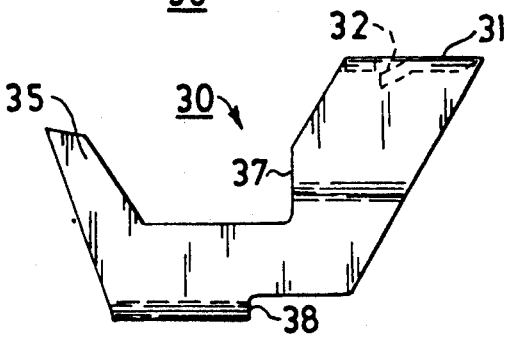
Figure 4C:
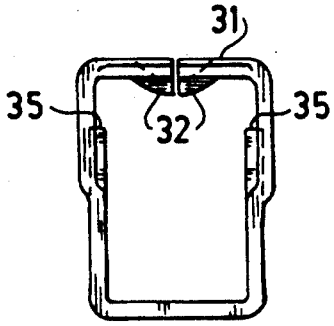

FIGS. 4A, B, and C are respectively plan, elevation, and end views of a locking element for the lock shoe system of FIGS. 1–3.

Figure 5A:
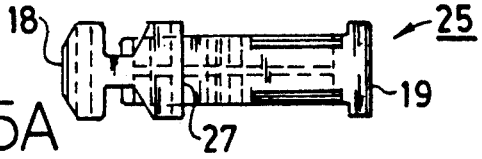
Figure 5B:
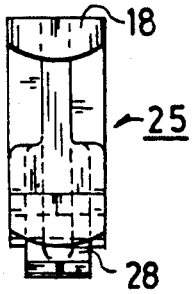
Figure 5C:
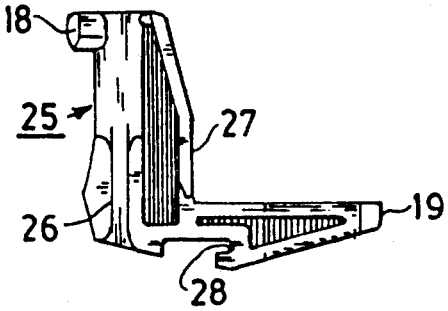

FIGS. 5A, B, and C are respectively plan, end, and elevation views of a shoe for the system of FIGS. 1–3.

Figure 6A:
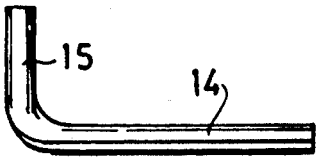

FIGS. 6A, B, and C are respectively elevation, end, and plan views of a sash pin and bracket for the system of FIGS. 1–3.

DETAILED DESCRIPTION

The inventive lock shoe system applies to a tilt sash using counterbalanced shoes running in shoe channels of resin jamb liners, such as are used in double-hung windows. Much of the details of the window, sash, jamb liner, and counterbalance are generally known in the art and are omitted from the illustration of the preferred embodiment, which concentrates on the lock shoe system. Possible variations of the preferred embodiment are not illustrated, even though some of these may be able to achieve the functions and results of the preferred embodiment.

Figure 6B:
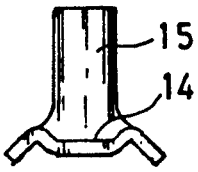
Figure 6C:
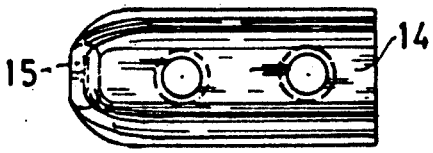

The portion of a window 10 illustrated in FIG. 1 includes, on the right hand side, a fragment of an untilted sash 11 and, on the left hand side, a tilted bracket 14 and pin 15 attached to a tilted sash that is omitted from FIG. 1, to simplify the illustration. Bracket 14 and pin 15 are also shown in the right hand side of FIG. 1 where bracket 14 is secured to sash 11 within a groove 13 formed in sash 11. Bracket 14 tilts with the sash it is attached to, and this tilts sash pin 15 as explained more fully below. Three views of bracket 14 are illustrated in FIGS. 6A–C. In the cutaway views of FIGS. 2 and 3, bracket 14 and sash pin 15 are illustrated in an untilted position in FIG. 2 and in a tilted position in FIG. 3, with the corresponding sash omitted from the view in each case.

Jamb liner 20 is illustrated as formed of extruded resin material, which is commonly used in the window art, and as having a pair of sash channels 21 and 22, which is required if the window is double-hung. Single-hung windows with a single movable sash are also possible, and jamb liners can have many different configurations. Each shoe channel of jamb liner 20 has a slot 23 that receives sash pin 15 for supporting a sash as it moves up and down between a pair of jamb liners 20. A spring or resilient cushion (not shown) allows jamb liner 20 to move laterally away from a sash as it tilts so that the ridges 23*a* on opposite sides of slot 23 can move aside of a tilted sash and bracket 14 can tilt clear of ridges 23*a*.

A shoe 25 runs vertically in each shoe channel of jamb liner 20 on each side of a window so that a pair of shoes 25 support any sash that is movable vertically within the window. Each shoe 25 carries a locking element 30, which connects to a counterbalance element such as a spring 40, shown in FIGS. 2 and 3. A spring connector region 31 of each locking element 30 has a spring coil retainer 32, but hook and loop and other connections between a spring or a counterbalance element and locking element 30 are also possible.

Locking element 30 has a biting edge 35 that can bite into and lock against a rib 45 that extends into each shoe channel of jamb liner 20. Locking rib 45 is spaced from the end or side walls of shoe channels 21 and 22 so that shoe 25 can straddle or extend around locking rib 45 and back up rib 45 against the biting force of edge 35 of locking element 30. This is accomplished in the illustrated preferred embodiment by spacing locking rib 45 inward from outer channel wall 24 of each respective shoe channel of jamb liner 20. This leaves room between rib 45 and wall 24 for shoe surface 26 to extend along the side of rib 45 opposite to the side engaged by biting edge 35. The backing up of rib 45 with a shoe surface 26 is important to prevent rib 45 from bending or flexing away from the biting action of edge 35. Locking devices that bite into resin material, such as walls of a shoe channel, have experienced many forms of failure attributable to the flexibility of the resin material that the biter is attempting to lock against. Backing up rib 45 with a shoe surface 26 so that it cannot flex away from biting edge 35 solves many serious problems that previous biters have experienced.

Locking element 30 is carried on shoe 25 so that it is free to pivot slightly relative to shoe 25. Many pivot arrangements can accomplish this, but I prefer that locking element 30 be arranged to straddle shoe 25 and extend underneath shoe 25 to abut against shoe 25 in pivot region 29. Such an arrangement has several advantages. It eliminates a separate pivot pin and thus simplifies the construction, and it also makes the assembly of locking element 30 and shoe 25 a simple matter of slipping locking element 30 over shoe 25. Pivot region 29 is preferably formed by an abutment 38 on locking element 30 engaging an abutment 28 on shoe 25. The interengagement of abutments 28 and 38 establishes a pivot axis in region 29, about which locking element 30 can pivot relative to shoe 25.

A counterbalance element, such as spring 40 connected to locking element 30, biases locking element 30 both upwardly and into locking position. The upward bias of locking element 30 also provides an upward counterbalance force on shoe 25, which in turn supports sash pin 15 to counterbalance a sash. The pivoting effect of the upward counterbalance force on locking element 30 biases biting edge 35 into locking engagement with rib 45, to lock shoe 25 against upward travel. Pin 15, by its presence and tilt angle in its operating position in shoe 25, controls the locking movement of element 30 so that shoe 25 locks only when a sash is tilted or removed from its normal vertical position between jamb liners 20.

Shoe 25 has a surface 27 confronting an opposed surface 37 of locking element 30, and sash pin 15 fits between confronting surfaces 27 and 37. These confronting surfaces form an open top slot into which pin 15 can be lowered, for replacing a sash into operative position. This has the advantage of letting a pin 15 of a previously removed sash be replaced into its operating position in shoe 25 simply by lowering pin 15 downward from above a locked shoe 25, which causes pin 15 to slide into position between confronting surfaces 37 and 27. This is much more convenient than having to insert a sash pin laterally into a recess in a locked shoe.

Sash pin 15 has a non-circular shape, preferably with rounded ends 16 as illustrated. The non-circular shape gives sash pin 15 a width greater than its thickness so that its horizontal dimension changes when it tilts from vertical toward horizontal. The horizontal dimension of sash pin 15 separates confronting surfaces 27 and 37 so that in an untilted position, as shown in FIG. 2, sash pin 15 separates confronting surfaces 27 and 37 by a maximum amount, which is enough to hold locking element 30 in an unlocked position with biting edge 35 clear of locking rib 45. Thus, in the normal vertical position of a sash, with sash pin 15 oriented as shown in FIG. 2, shoe 25 is unlocked and free to move vertically so that a sash can be raised and lowered.

When a sash tilts, pin 15 also tilts, as illustrated in FIG. 3; and tilting makes the non-circular shape of pin 15 reduce the separation of confronting surfaces 27 and 37, allowing locking element 30 to pivot as its confronting surface 37 approaches closer to shoe surface 27. This moves biting edge 35 into locking engagement with rib 45 and locks shoe 25 against moving upward under the bias of counterbalance element 40.

Shoe 25 also locks if pin 15 is withdrawn laterally from shoe 25, because this also allows locking element surface 37 to approach closer to shoe surface 27. Lateral withdrawal of pin 15 from an unlocked shoe 25 does not normally occur, but can be accomplished by lifting one sash pin up out of a shoe 25, without removing the other sash pin from the opposite shoe, and then returning the sash to a near vertical position before laterally withdrawing the second pin. No window system intends for such a sequence of events to occur; but if it were to happen, this system is fail-safe, because lateral removal of a sash pin, like tilting a sash pin, reduces the separation between confronting surfaces 27 and 37, allowing element 30 to pivot biting edge 35 into locking rib 45.

In the illustrated preferred embodiment of a tilt sash lock shoe system, shoes 25 can be used in either right hand or left hand positions on either side of a sash, and pins 15 can tilt in either direction relative to shoes 25 to accomplish the locking shown in FIG. 3. Also, locking element 30, straddling shoe 25, preferably has a pair of biting edges 35, even though only one of the biting edges 35 actually locks against rib 45 in any shoe channel. The effect of this can be seen in FIG. 1, where the shoe in the right hand channel is rotated 180° from the shoe in the left hand channel. In each channel 21 and 22, locking rib 45 is preferably disposed on the sash side of the channel so that reversing a shoe, to orient it respectively in one of the channels, disposes a different one of the biting edges 35 adjacent a locking rib 45. Placing rib 45 on the sash side of the shoe channel is preferred for minimizing the distance between the tilted sash and the locking point. It is also possible to use two locking ribs 45 disposed on opposite sides of each channel so that both biting edges 35 bite into and lock against a respective one of the ribs 45.

Shoe 25 provides friction that is desirable in most balance systems for holding a sash in any vertical position, even though the force of the counterbalance element varies somewhat at different sash heights. Since the upward force of counterbalance element 40 is offset from sash pin 15, which supports the weight of a sash, the resulting moment arm tends to tilt or torque shoe 25 in its channel. This causes upper and lower corners of shoe 25 to rub against channel walls, producing friction that is a function of the spring force and the sash weight. This friction is exerted through an upper shoe surface 18 and a lower shoe surface 19 respectively engaging outer jamb channel wall 24 and inner jamb channel wall 23.

Several moment arms are involved in the operation of the illustrated shoe system. The engagement of counterbalance spring element 40 with connector region 31 of locking element 30 is spaced from pivot region 29 by a larger moment arm distance than the point of engagement of pin 15 with confronting surface 37 of locking element 30. Also, the moment arm distance between biting edge 35 and pivot region 29 is greater than the moment arm distance between pivot region 29 and the engagement region of pin 15 with confronting surface 37. These relationships result in the moment arm of the counterbalance element tending to pivot locking element 30 being larger than the moment arm provided by pin 15 in resisting such movement so that the spring force can exert a pivoting force at an ample moment arm on locking element 30, the force of which pin 15 can resist by virtue of its trapped position between confronting surfaces 37 and 27. Then, a small change in the horizontal dimension of pin 15 as the sash tilts can allow a small convergence of confronting surfaces 27 and 37 to produce a larger movement of biting edge 35 toward locking engagement with rib 45. This ensures that locking element 30 is biased into locking position by ample force, is moved into locking position by a small tilt of around 45° of pin 15, and is easily held out of locking position by the untilted presence of pin 15 between confronting surfaces 37 and 27.

Another moment arm exists between the upward bias of counterbalance element 40 and the downward weight of a sash exerted on pin 15 engaging shoe 25 in a position offset from spring 40. This moment arm biases shoe 25 to press friction surfaces 18 and 19 against respective channel walls 24 and 23 for providing the friction necessary to prevent hop or drop.

By functioning as described above, the illustrated shoe system overcomes the disadvantages and failures of previous tilt sash lock shoe systems, as explained above. It also accomplishes this with simple and inexpensive components that make it economical to manufacture.

I claim:

1. A tilt sash lock shoe system using a counterbalanced shoe running in a shoe channel of a resin jamb liner, said system comprising:

a. a locking rib extending into said shoe channel;

b. said shoe being configured to run against walls of said channel and to have a backing surface disposed adjacent a back side of said locking rib;

c. a locking element carried by said shoe and biased by a counterbalance into a locked position in which a biting edge of said lock element bites into a front side of said rib;

d. a non-circular sash pin carried by a sash and supported by said shoe at the bottom of an open topped slot in said shoe where said pin engages and separates confronting surfaces of said shoe and said locking element; and e. said sash pin being configured for separating said confronting surfaces by enough to hold said locking element out of said locked position when said sash is untilted and for reducing the separation of said confronting surfaces to move said locking element into said locked position when said sash tilts.

2. The system of claim 1 wherein a moment arm of said sash pin engagement with said locking element is shorter than a moment arm for said biting edge.

3. The system of claim 2 wherein said moment arm for said sash pin engagement with said locking element is shorter than a moment arm for said counterbalance engagement with said locking element.

4. The system of claim 1 wherein withdrawal of said sash pin from said slot also reduces said separation of said confronting surfaces and moves said locking element into said locked position.

5. The system of claim 1 wherein said shoe backing surface is opposite said biting edge.

6. The system of claim 1 wherein frictional corner surfaces of said shoe run against walls of said channel in regions spaced from said rib.

7. The system of claim 1 wherein tilting of said sash pin in either direction relative to said shoe slot reduces said separation of said confronting surfaces and moves said locking element into said locked position.

8. The system of claim 1 wherein said shoe is configured to have a slot straddling said rib in the region of said biting edge.

9. The system of claim 1 wherein said rib is formed on a sash side of said shoe channel.

10. In a tilt sash lock shoe system having a counterbalanced shoe running in a resin shoe channel of a jamb liner, a locking element pivotally mounted on said shoe so that a biting edge of said locking element is disposed for biting into locking engagement with a portion of said jamb liner, the improvement comprising:

a. a rib projecting into said shoe channel in a position spaced from shoe-guiding walls of said channel, said rib having a front face disposed for locking engagement with said biting edge and a rear face backed up by a surface of said shoe;

b. a counterbalance connected to said locking element to impart a counterbalance lift to said shoe and to bias said locking element into said locking engagement; and c. a non-circular sash pin carried by a sash and disposed for resting on said shoe in a region where said sash pin engages confronting surfaces of said shoe and said locking element to separate said confronting surfaces by amounts that vary with the angle of said sash pin so that when said sash is untilted, said sash pin separates said confronting surfaces by enough to hold said locking element in an unlocked position and when said sash tilts, said sash pin reduces the separation of said confronting surfaces by enough to move said locking element into said locking engagement.

11. The improvement of claim 10 wherein a moment arm for the engagement of said sash pin with said confronting surface of said locking element is shorter than a moment arm for said biting edge of said locking element.

12. The improvement of claim 11 wherein said moment arm for said sash pin engagement with said confronting surface of said locking element is shorter than a moment arm for said counterbalance engagement with said locking element.

13. The improvement of claim 12 wherein said moment arm of said counterbalance engagement with said locking element is at least as long as said moment arm of said biting edge.

14. The improvement of claim 10 wherein corner friction surfaces of said shoe run against said shoe-guiding walls of said channel.

15. The improvement of claim 10 wherein withdrawal of said sash pin from said shoe enables said biting edge to move into said locking engagement with said rib.

16. The improvement of claim 10 wherein said sash pin is movable vertically up out of and down into a slot formed in said shoe between said confronting surfaces.

17. The improvement of claim 10 wherein said locking element straddles said shoe and pivots against an underside of said shoe without requiring a pivot pin.

18. The improvement of claim 10 wherein tilting of said sash pin in either direction relative to said shoe reduces the separation of said confronting surfaces by enough to move said locking element into said locking engagement.

19. The improvement of claim 10 wherein said rib is formed on a sash side of said shoe channel.

20. In a tilt sash lock shoe system using a locking element connected to a counterbalance element to bias a biting edge of said locking element into engagement with a portion of a shoe channel in a resin jamb liner, said locking element being held in an unlocked position by presence of a non-circular sash pin resting in a shoe, the improvement comprising:

a. said sash pin, in said shoe, engaging a surface of said locking element at a moment arm that is substantially shorter than a moment arm for the engagement of said counterbalance element with said locking element; and b. said sash pin, in said shoe, engaging a shoe surface confronting said locking element surface so that tilting of said sash pin in response to tilting of a sash carrying said sash pin allows a small movement of said locking element surface at said sash pin and a substantially larger movement of said locking element at said biting edge.

21. The improvement of claim 20 wherein said portion of said channel engaged by said biting edge comprises a rib extending into said channel and into a slot in said shoe.

22. The improvement of claim 21 wherein a surface of said shoe backs up said rib in a region opposite said biting edge.

23. The improvement of claim 21 wherein corner friction surfaces of said shoe run against walls of said channel spaced from said rib.

24. The improvement of claim 20 wherein a pivot axis for said locking element is formed by an abutment on said shoe, without requiring a pivot pin.

25. The improvement of claim 20 wherein said locking element straddles and extends under said shoe to impart lift from said counterbalance element to said shoe.

26. The improvement of claim 20 wherein tilting of said sash pin in either direction relative to said shoe causes said movement of said locking element.

27. The improvement of claim 20 wherein said moment arm for said engagement of said counterbalance element with said locking element is at least as long as a moment arm for said biting edge.

28. The improvement of claim 20 wherein withdrawal of said sash pin from said shoe causes said movement of said locking element.

29. The improvement of claim 20 wherein said rib is formed on a sash side of said shoe channel.

30. The improvement of claim 20 wherein a moment arm between said counterbalance element and said sash pin torques said shoe into frictional engagement with walls of said channel.

31. In a tilt sash locking system having a shoe running in a shoe channel in a resin jamb liner and carrying a locking element having a biting edge biased toward biting engagement with a rib backed up by a surface of said shoe, and a sash pin disposed for holding said locking element out of said biting engagement, the improvement comprising:

a. confronting surfaces of said shoe and said locking element forming an open top slot having a bottom formed by said shoe so that said sash pin can move vertically up out of said slot and down into said slot and can rest on said shoe in an operating position;

b. said bias of said locking element toward said biting engagement is provided by a counterbalance element connected to said locking element to urge said confronting surfaces closer together;

c. said sash pin having a width that separates said confronting surfaces in said unlocked position to dispose said biting edge clear of said rib; and d. said sash pin, upon tilting with said sash, reduces the separation of said confronting surfaces and allows said locking element to move into said biting engagement.

32. The improvement of claim 31 wherein a moment arm of said sash pin engagement with said locking element is substantially shorter than a moment arm of said biting edge so that a small movement of said confronting surfaces toward each other produces a larger movement of said biting edge toward said rib.

33. The improvement of claim 32 wherein a moment arm of the counterbalance element connection to said locking element is at least as long as said moment arm of said biting edge.

34. The improvement of claim 31 wherein lateral withdrawal of said pin from said shoe allows said locking element to move into said biting engagement.

35. The improvement of claim 31 wherein tilt of said sash pin in either direction relative to said shoe reduces the separation of said confronting surfaces and allows said locking element to move into said biting engagement.

36. The improvement of claim 31 wherein said locking element straddles said shoe and engages an abutment of said shoe along a pivot axis for said locking element.

37. The improvement of claim 31 wherein said rib is formed on a sash side of said shoe channel.

38. The improvement of claim 31 wherein said shoe and said locking element are operable on either side of said sash.

39. The improvement of claim 31 wherein said locking element is interassembled with said shoe without a pivot pin.

40. The improvement of claim 31 wherein a moment arm between said counterbalance element and said sash pin torques said shoe into frictional engagement with walls of said channel spaced from said rib.

* * * * *